United States Patent [19]

Allerdist et al.

[11] Patent Number: 4,726,205

[45] Date of Patent: Feb. 23, 1988

[54] IGNITION KEY WITH TRANSMITTER

[75] Inventors: Heinz Allerdist, Bad Homburg; Klaus Rathmann, Frankfurt am Main, both of Fed. Rep. of Germany

[73] Assignee: VDO Adolf Schindling AG, Frankfurt am Main, Fed. Rep. of Germany

[21] Appl. No.: 836,905

[22] Filed: Mar. 6, 1986

[30] Foreign Application Priority Data

Mar. 16, 1985 [DE] Fed. Rep. of Germany ..... 3509579

[51] Int. Cl.[4] ..... E05B 19/04

[52] U.S. Cl. ..... 70/395; 70/393; 70/408

[58] Field of Search ..... 70/395, 397, 393, 408, 70/413

[56] References Cited

U.S. PATENT DOCUMENTS

| | | | |
|---|---|---|---|
| 3,022,408 | 2/1962 | Wagner | 70/395 X |
| 3,579,183 | 5/1971 | Lipschutz | 70/395 X |
| 4,562,712 | 1/1986 | Wolter | 70/395 X |

FOREIGN PATENT DOCUMENTS

| | | | |
|---|---|---|---|
| 116868 | 8/1984 | European Pat. Off. | 70/402 |
| 2750634 | 5/1979 | Fed. Rep. of Germany | 70/393 |
| 3244855 | 6/1984 | Fed. Rep. of Germany . | |
| 3521417 | 5/1986 | Fed. Rep. of Germany | 70/352 |
| 2411290 | 8/1979 | France | 70/408 |
| 2039321 | 8/1980 | United Kingdom | 70/395 |
| 2155988 | 10/1985 | United Kingdom | 70/395 |

*Primary Examiner*—Robert L. Wolfe
*Assistant Examiner*—Suzanne L. Dino
*Attorney, Agent, or Firm*—Martin A. Farber

[57] ABSTRACT

An ignition key consists of two structural units which are detachably connected to each other. One of the structural units contains the transmitter electronics and the key shank, while the other structural unit contains the battery and a button for connecting the battery to the transmitter electronics. The attachment of the two structural parts to each other is effected by means of dovetail guides.

8 Claims, 1 Drawing Figure

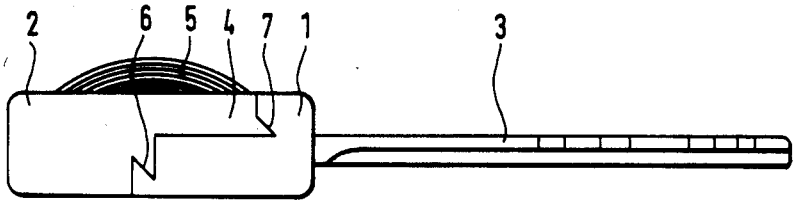
2
6
5
4
7
1
3

IGNITION KEY WITH TRANSMITTER

FIELD AND BACKGROUND OF THE INVENTION

The present invention relates to an ignition key for a motor vehicle particularly an automobile having a battery-operated transmitter by which a central interlock can be actuated. Such an ignition key is described, for instance, in Federal Republic of Germany OS No. 32 44 855.

In the case of the previously known ignition key, the battery is arranged in a key case which is connected by a connecting wire to the ignition key. This has the advantage that it is not necessary to open the housing which contains the transmitter electronics in order to change the battery. As a result of this, the transmitter electronics can be arranged in a well sealed-off manner. Furthermore, there is no danger of inflicting damage when changing the battery.

Experience has shown that replacing a battery frequently presents difficulties. This can be due, for instance, to the fact that the battery to be replaced is very small and the handling thereof requires dexterity, or else due to the fact that several batteries must be inserted with different directions of polarity so that the possibility of incorrect polarity is present.

SUMMARY OF THE INVENTION

The object of the present invention is to develop an ignition key of the aforementioned type in such a way that, on the one hand, the transmitter electronics can be arranged in well-protected manner while, on the other hand, the battery can be replaced rapidly and in the simplest possible way.

This object is achieved, in accordance with the present invention, wherein the ignition key consists of two structural units which are detachably connected to each other, one of them containing the transmitter electronics and the key shank while the other contains the battery.

By this development it is no longer necessary, when replacing the battery or batteries, to handle an individual battery or batteries; rather, the entire unit is replaced by a battery inserted by the manufacturer. In this way, the replacement of the battery can be carried out very simply and rapidly and without the possibility of error. Furthermore, the transmitter electronics can be arranged in hermetically sealed manner, for instance encapsulated.

It is particularly advantageous if the structural unit having the battery also contains a button for actuating the transmitter by connecting the transmitter to the battery. In this way whenever the battery is replaced, the button is simultaneously replaced, which is advantageous since the life of a button is limited and corresponds, in the case of such a transmitter, approximately to the life of a battery. Aside from this, the structural expense for the overall arrangement is particularly low as a result of this arrangement.

The attachment of the structural unit containing the battery to the other unit is particularly simple to produce and handle with the structural unit containing the battery being attached to the other unit by means of a dovetail-like guide. Of course, this attachment must be of such a nature that the electric connection is produced simultaneously with the insertion of the structural unit containing the battery.

A sufficiently large surface for the provision of the button can be obtained in simple fashion with the structural unit containing the battery having an extension which extends in part over the structural part containing the transmitter electronics and with the button being arranged partially within the region of said extension.

BRIEF DESCRIPTION OF THE DRAWING

The invention permits numerous embodiments. In order to make its basic principle clear, one embodiment has been shown diagrammatically in the only FIGURE in side elevational view and will be described below by way of example.

DETAILED DESCRIPTION OF THE PREFERRED EMBODIMENT

The ignition key shown in the drawing consists of two structural units 1 and 2. The structural unit 1 contains a transmitter electronics (not shown) and a key shank 3 by which the ignition lock is to be actuated.

Within the structural unit 2 there is a battery, also not shown, for supplying the transmitter electronics with energy. An extension 4 of the structural unit 2 engages over the structural unit 1 and is provided with a button 5 on the surface thereof which is enlarged by the extension 4. By depressing this button 5 the transmitter electronics in the structural unit 1 is provided with energy from the battery in the structural unit 2.

The attachment of the structural unit 2 to the structural unit 1 is effected by dovetail guides 6, 7 in such a manner that in order to replace the structural unit 2, said structural unit 2 need only be pushed towards the side. When the new structural unit 2 is pushed on, the necessary electrical connections are effected in positive fashion.

We claim:

1. In an ignition key for an automotive vehicle having a battery-operated transmitter by which a central lock on the vehicle is actuatable, the improvement wherein the ignition key comprises two structural units which are detachably connected to each other, one of said structural units contains transmitter electronics for the transmitter and includes a key shank, and the other of said structural units contains a battery for operating said transmitter electronics, said battery being integrally formed with said other structural unit, said other structural unit being discardable as a replaceable part, and having a physical configuration permitting handling with minimum dexterity.

2. The ignition key according to claim 1, wherein said other structural unit containing the battery further contains means comprising a button for actuating the transmitter by connecting the transmitter electronics to the battery, said button being integrally formed with said other structural unit.

3. The ignition key according to claim 1, wherein said structural units are attached to each other by means of cooperating dovetail guides formed on said structural units.

4. The ignition key according to claim 2, wherein said structural units are attached to each other by means of cooperating dovetail guides formed on said structural units.

5. The ignition key according to claim 1, wherein said other structural unit has an extension, said extension partially engages over said one structural unit, and said button is arranged partially in said extension and is integrally formed therewith.

6. The ignition key according to claim 1, wherein said transmitter electronics is hermetically sealed by being encapsulated in said one structural unit.

7. The ignition key according to claim 1, wherein each of said structural units is formed in one piece.

8. In an ignition key for an automotive vehicle having a battery-operated transmitter by which a central lock on the vehicle is actuatable, the improvement wherein the ignition key consists of two structural units which are detachably connected to each other, one of said structural units contains transmitter electronics for the transmitter and includes a key shank, and the other of said structural units contains a battery for operating said transmitter electronics, said battery being integrally formed with said other structural unit, said other structural unit being discardable as a replaceable part, and having a physical configuration permitting handling with minimum dexterity.

* * * * *